US009234347B2

(12) United States Patent
Cossette et al.

(10) Patent No.: US 9,234,347 B2
(45) Date of Patent: Jan. 12, 2016

(54) CROSSED TIES FOR CONSTRUCTION BLOCK ASSEMBLY

(71) Applicants: Andŕe Cossette, Quebec (CA); Lyhieryl P. Demegillo, Quebec (CA)

(72) Inventors: Andŕe Cossette, Quebec (CA); Lyhieryl P. Demegillo, Quebec (CA)

( * ) Notice: Subject to any disclaimer, the term of this patent is extended or adjusted under 35 U.S.C. 154(b) by 0 days.

(21) Appl. No.: 14/171,878

(22) Filed: Feb. 4, 2014

(65) Prior Publication Data

US 2015/0218806 A1 Aug. 6, 2015

Related U.S. Application Data

(60) Provisional application No. 61/760,397, filed on Feb. 4, 2013.

(51) Int. Cl.
*E04B 2/86* (2006.01)

(52) U.S. Cl.
CPC ..... *E04B 2/8617* (2013.01); *E04B 2/8611* (2013.01); *E04B 2/8635* (2013.01)

(58) Field of Classification Search
CPC ..... E04B 2002/867; E04B 2/8617; E04B 2/8652; E04B 2/8635; E04B 2/8611
USPC ..... 52/426, 562, 424, 309.11, 677, 565, 52/699, 431, 657, 695; 249/40, 38, 213, 249/216
See application file for complete search history.

(56) References Cited

U.S. PATENT DOCUMENTS

| | | | |
|---|---|---|---|
| 915,195 | A | 3/1909 | Lemb |
| 994,027 | A | 5/1911 | O'Beirne |
| 1,420,478 | A | 6/1922 | Walter |
| 2,703,487 | A | 3/1955 | Ossoinack |
| 3,318,062 | A | 5/1967 | Grants |
| 3,653,170 | A | 4/1972 | Sheckler |
| 3,791,090 | A | 2/1974 | Kniefel |
| 3,982,369 | A | 9/1976 | Keleske |

(Continued)

FOREIGN PATENT DOCUMENTS

| | | |
|---|---|---|
| CA | 2 585 790 | 6/2006 |
| FR | 2 544 359 | 10/1984 |

(Continued)

OTHER PUBLICATIONS

International Search Report PCT/CA2014/000075 dated Jun. 11, 2014.

(Continued)

*Primary Examiner* — Robert Canfield
*Assistant Examiner* — Babajide Demuren

(57) ABSTRACT

An assembly of interconnected blocks such, as lightweight concrete, rock, or wood blocks, in combination with crossed ties means used for attaching blocks two by two while keeping them in a stable spaced apart position. The crossed ties comprise a rectangular shape wherein opposite corners are joined by straight links which resist shear forces due to wind, storm, tornadoes, landslides or earthquake. They comprise furthermore pegs which attach the blocks two by two when pressing pegs into notches dug on upper or lower surfaces of the blocks or on their sides. The blocks are then made with, notches on upper or lower surfaces of the blocks, and on their sides, which correspond to positions of pressing pegs, to interconnect blocks together. Such pegs are provided to mesh with critical positions in the blocks for stable junctions.

15 Claims, 3 Drawing Sheets

(56) References Cited

U.S. PATENT DOCUMENTS

| | | | | | |
|---|---|---|---|---|---|
| 4,018,018 | A | | 4/1977 | Kosuge | |
| 4,190,995 | A | | 3/1980 | Armistead | |
| 4,312,164 | A | | 1/1982 | Walt et al. | |
| 4,433,520 | A | | 2/1984 | Maschhoff | |
| 4,439,967 | A | | 4/1984 | Dielenberg | |
| 4,498,266 | A | | 2/1985 | Perreton | |
| 4,574,550 | A | | 3/1986 | Maschhoff | |
| 4,706,429 | A | | 11/1987 | Young | |
| 4,833,856 | A | | 5/1989 | Zwagerman | |
| 4,854,097 | A | | 8/1989 | Haener | |
| 4,866,891 | A | | 9/1989 | Young | |
| 4,884,382 | A | * | 12/1989 | Horobin | 52/426 |
| 4,889,310 | A | | 12/1989 | Boeshart | |
| 5,065,561 | A | | 11/1991 | Mason | |
| 5,086,600 | A | | 2/1992 | Holland et al. | |
| 5,390,459 | A | * | 2/1995 | Mensen | 52/426 |
| 5,428,933 | A | | 7/1995 | Philippe | |
| 5,459,971 | A | | 10/1995 | Sparkman | |
| 5,566,518 | A | | 10/1996 | Martin et al. | |
| 5,657,594 | A | | 8/1997 | Morita et al. | |
| 5,657,600 | A | * | 8/1997 | Mensen | 52/426 |
| 5,658,483 | A | | 8/1997 | Boeshart | |
| 5,687,531 | A | | 11/1997 | Nelson et al. | |
| 5,704,180 | A | * | 1/1998 | Boeck | 52/426 |
| 5,709,060 | A | * | 1/1998 | Vaughan et al. | 52/426 |
| 5,782,050 | A | | 7/1998 | Boeshart | |
| 5,845,448 | A | | 12/1998 | Potvin | |
| 5,890,337 | A | | 4/1999 | Boeshart | |
| 5,896,714 | A | * | 4/1999 | Cymbala et al. | 52/426 |
| 5,983,585 | A | | 11/1999 | Spakousky | |
| 5,992,114 | A | * | 11/1999 | Zelinsky et al. | 52/426 |
| D435,212 | S | | 12/2000 | Philippe | |
| 6,176,059 | B1 | * | 1/2001 | Cantarano et al. | 52/578 |
| 6,226,951 | B1 | | 5/2001 | Azar | |
| 6,230,462 | B1 | | 5/2001 | Beliveau | |
| 6,253,519 | B1 | | 7/2001 | Daniel | |
| 6,301,851 | B1 | | 10/2001 | Matsubara | |
| 6,324,804 | B1 | | 12/2001 | Hoogstraten | |
| 6,352,237 | B1 | * | 3/2002 | Severino | 249/194 |
| 6,378,260 | B1 | | 4/2002 | Williamson et al. | |
| 6,401,419 | B1 | * | 6/2002 | Beliveau | 52/592.6 |
| 6,536,172 | B1 | * | 3/2003 | Amend | 52/426 |
| 6,668,503 | B2 | | 12/2003 | Beliveau | |
| 6,698,710 | B1 | * | 3/2004 | VanderWerf | 249/216 |
| 6,820,384 | B1 | * | 11/2004 | Pfeiffer | 52/426 |
| 6,821,058 | B1 | | 11/2004 | Dawson | |
| 6,886,303 | B2 | * | 5/2005 | Schmidt | 52/562 |
| 6,931,806 | B2 | * | 8/2005 | Olsen | 52/309.11 |
| 6,978,581 | B1 | * | 12/2005 | Spakousky | 52/405.4 |
| 7,007,436 | B1 | | 3/2006 | Kelley | |
| 7,082,732 | B2 | | 8/2006 | Titishov | |
| 7,665,710 | B2 | | 2/2010 | Cooper | |
| 7,739,846 | B2 | | 6/2010 | Garrett | |
| RE41,994 | E | | 12/2010 | Mensen | |
| 8,555,588 | B2 | | 10/2013 | Stokes | |
| 8,733,051 | B2 | | 5/2014 | Griffith | |
| 2001/0029717 | A1 | | 10/2001 | Spakousky | |
| 2002/0092253 | A1 | | 7/2002 | Beliveau | |
| 2003/0213198 | A1 | | 11/2003 | Bentley | |
| 2005/0005556 | A1 | | 1/2005 | Collier et al. | |
| 2005/0120659 | A1 | * | 6/2005 | Nickerson | 52/506.01 |
| 2006/0117690 | A1 | | 6/2006 | Garrett | |
| 2007/0199273 | A1 | | 8/2007 | Wang | |
| 2010/0284751 | A1 | | 11/2010 | Price | |
| 2012/0090259 | A1 | | 4/2012 | Muirhead et al. | |
| 2014/0215949 | A1 | | 8/2014 | Cossette et al. | |

FOREIGN PATENT DOCUMENTS

| | | |
|---|---|---|
| FR | 2 566 817 | 1/1986 |
| KR | 2003-0024425 | 3/2003 |
| WO | WO 2014-117260 A1 | 8/2014 |
| WO | WO 2014-117260 A8 | 8/2014 |

OTHER PUBLICATIONS

CIPO Examination Notes dated Aug. 7, 2014.
Non-Final Office for U.S. Appl. No. 13/758,373 dated Apr. 17, 2015.

* cited by examiner

CROSSED TIES FOR CONSTRUCTION BLOCK ASSEMBLY

FIELD OF THE INVENTION

This invention belongs to the field of means for attachment for construction blocks and particularly crossed ties therefor.

DESCRIPTION OF THE PRIOR ART

The present invention refers to a previous provisional application U.S. 61,760,397 having same title and filed, on Feb. 4, 2013 by same inventor. Our research among patents revealed some systems that caught our attention:

U.S. Pat. No. 7,415,804 <<Web structure for insulating concrete block>> filed on Sep. 23, 2010 by David Michael GARRETT (US) shows means of attachment of two parallel panels comprising web structures 16 placed perpendicularly to the panels in the space between them with means of interconnection.

U.S. Pat. No. 7,415,804 <<Insulated concrete form having welded tie>> filed, on Sep. 4, 2003 by Jerry D. Coombs and al. (US) shows metal wire ties comprising horizontal and vertical members used to interconnect two opposing parallel panels.

OBJECTIVES AND ADVANTAGES

Light weight, concrete, rock or wood blocks need a frame which maintains a spaced apart position of the construction blocks and avoids shifting when the blocks are subjected to oscillating during wind, storm, tornadoes, landslides or earthquake. The present invention provides means for attaching blocks two by two and keep them stable in a spaced apart position resisting shear forces. The crossed ties interconnecting blocks are comprising a rectangular shape wherein opposite corners are joined by straight links to avoid shifting when the blocks are subjected to oscillating. Pegs are provided to mesh with critical positions in the blocks for stable junctions.

With such attachments, the blocks are made with notches on upper and lower surfaces of the blocks and on their sides. The crossed ties are then pressed tight into the notches of the block. Means of lilting can be provided to lift an assembly of blocks interconnected with crossed ties.

The present invention will be further understood from the following description with reference to the drawings wherein like numbers refer to like parts for easy identification.

DRAWING FIGURES

DETAILED DESCRIPTION OF THE DRAWINGS

Figure 1:
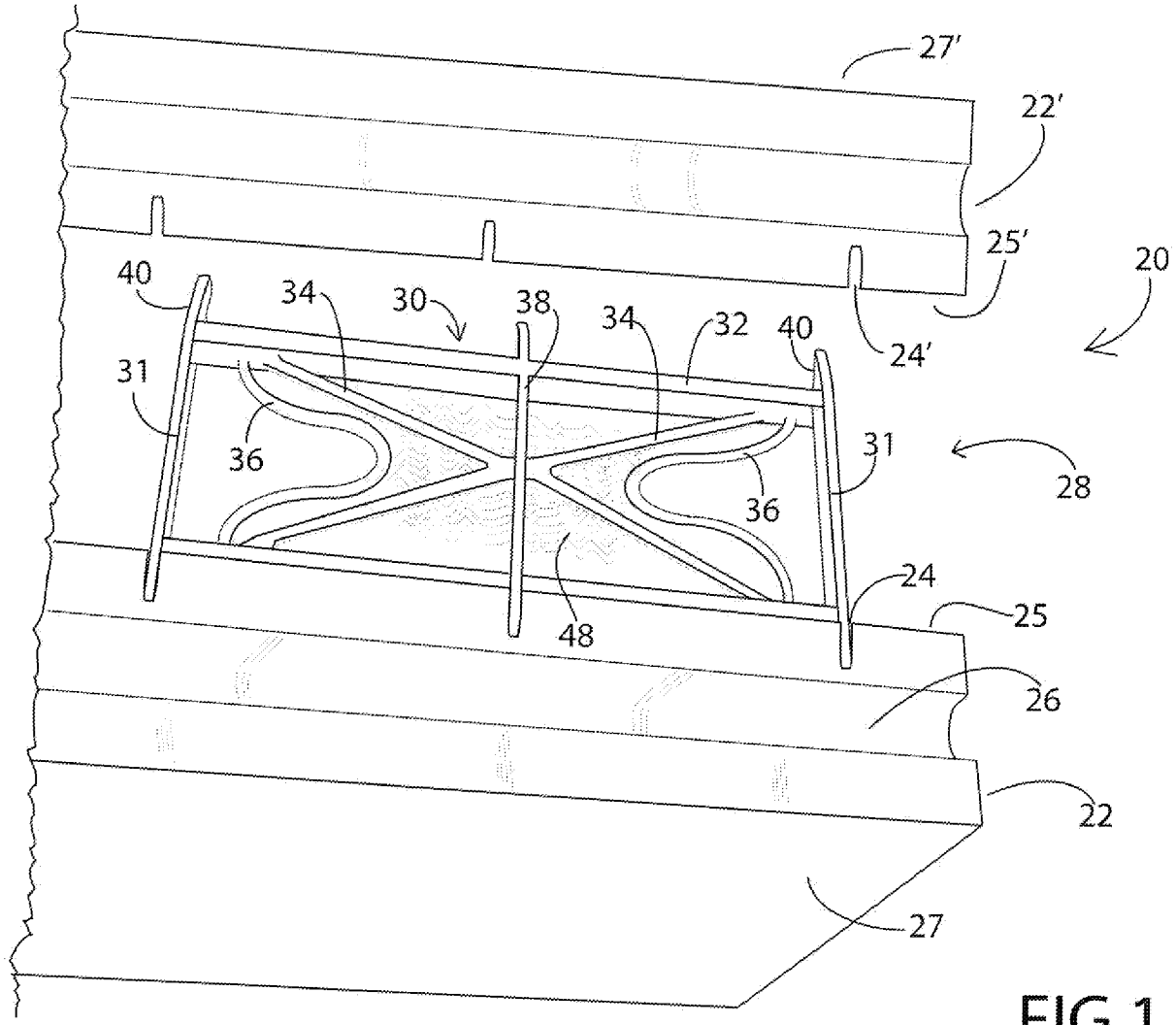
FIG. 1 is a perspective of blocks with a crossed tie.

FIG. 1 shows an assembly 20 of blocks showing blocks 22,22' comprising exterior face 27,27' and interior face 25,25' comprising a number of notches 24 and a channel 26. A crossed tie 28 comprising a rectangular frame 30 has end members 31, side members 32, a pair of diagonal members, straight links 34, and a pair of means of lifting 36 acting as means of handles. A center transversal member 38 is also present. Pegs 40 complete end and center members, and they enter the notches 24,24" to ascertain a proper junction with each block 22,22'. The in between blocks 48 are filled with an insulated material to provide sound barrier as well as thermal shield.

Figure 2:
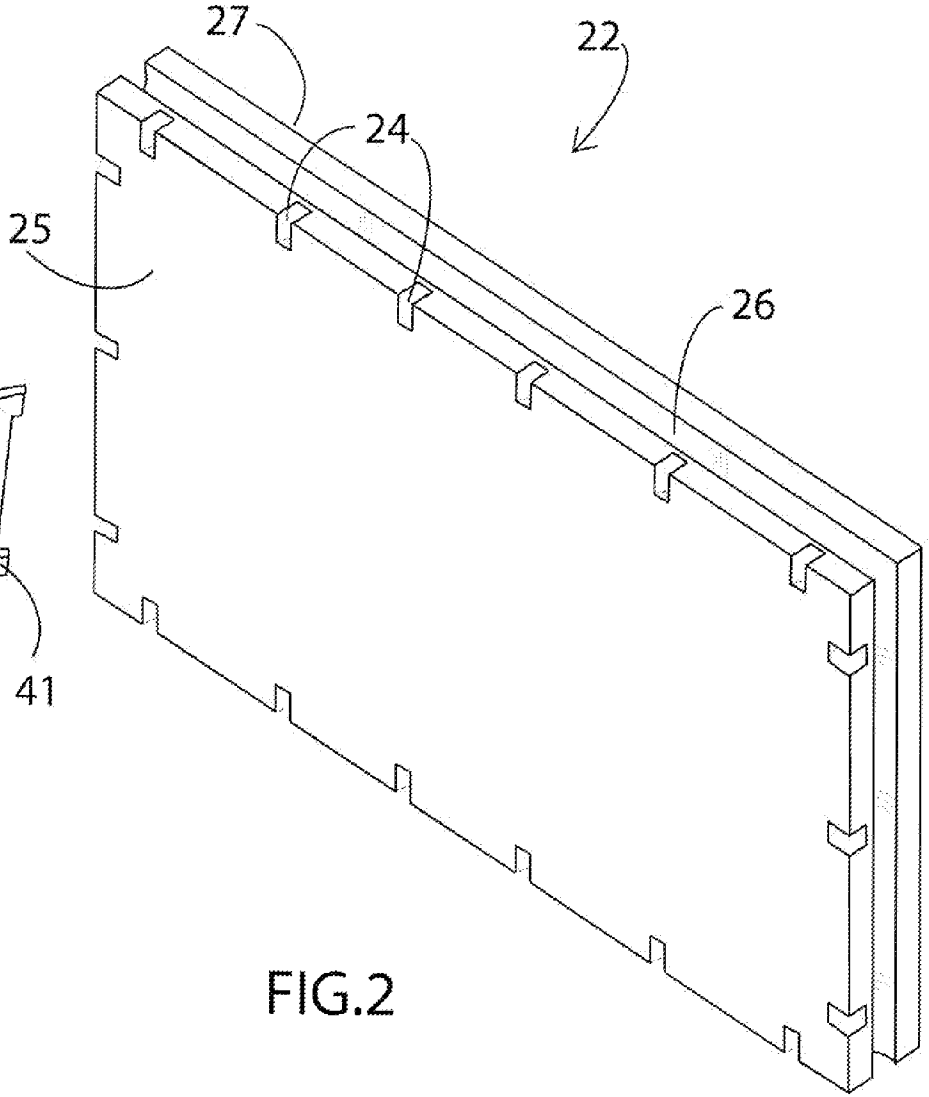
FIG. 2 is a perspective of a block with notches.

FIG. 2 shows a block 22 with an interior face 25 and an exterior face 27. The block is provided with notches 24 all around the interior face and a channel 26 intended to receive rods to strengthen the whole assembly of blocks, when erecting a wall.

Figure 3:
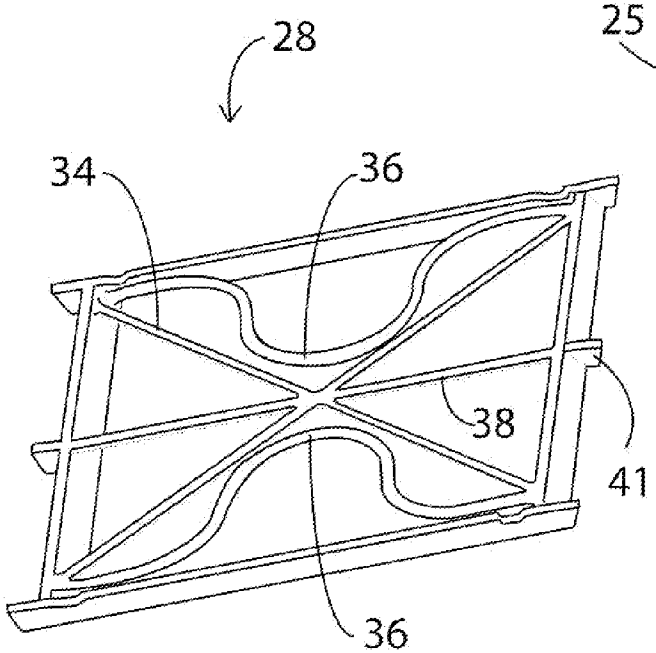
FIG. 3 is a perspective of a crossed tie with flat pegs.

FIG. 3 shows the crossed ties 28 comprising flat pegs 41, the center transversal member 38, diagonal straight links 34, and means of lifting 36.

Figure 4:
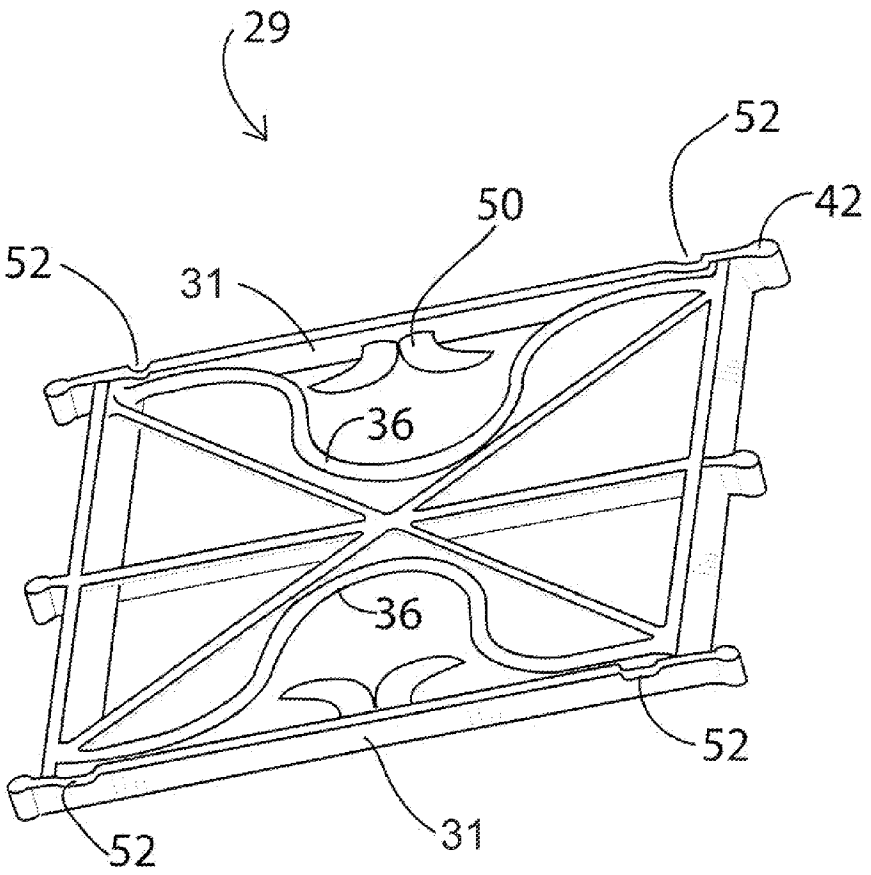
FIG. 4 is a perspective of a crossed tie with round pegs.

FIG. 4 shows a crossed tie 29 with round pegs 42 and a retainer hook 50 to attach rubber rings. Channels 52 are made in rectangular-shape end members 31 to pass the means of lifting 36 through, thus avoiding gap between two interconnected blocks pressed aside against each other, when erecting wall construction.

SUMMARY

An assembly of at least two parts of blocks made of light weight, concrete, wood, or rock, parallel, angular, radius, T-shape, shaft-shape. Between the parts, a void channel or filled channel with an insulating substance like mineral wool and/or roxul or blown in spray insulation. The channels provide a sound barrier and insulation. Crossed ties are used such as means of attachment to prefix or preassemble the blocks together in the construction of a double wall structure. The crossed ties are in a shape of a rectangle wherein opposite corners are joined by straight links for avoiding shifting when the blocks are subjected to oscillating during wind, storm, landslides, tornadoes, hurricanes or earthquake, The pegs are in a rectangular or a circular shape.

With such attachments, the blocks are made with notches on upper or lower surfaces of the blocks and on their sides. The pegs of the crossed ties are then pressed tight into the notches of the block. The crossed ties are provided with means of lifting, in a snake shape, to lift the assembled blocks with crossed ties fastened.

Two blocks joined with means of attachment as crossed ties could be of different materials, such as a marble block joined with a rock block, or a cement block joined with a colored cement block or a wood block. The rows of blocks are held by passing through metal rods which position any two blocks in a series to form a wall, with armoured rebar rods.

The crossed ties can comprise a retainer hook destined to hook on rubber rings to keep parallel back and front blocks together when erecting sound barrier walls.

More precisely, our invention comprises a combination of parallel spaced apart blocks 22-22' interconnected with a rectangular-shape crossed tie 28. Each block comprises an interior face 25-25' comprising means of notches 24 on the periphery. The crossed tie 28 comprises:

- four pegs 40 extending out of the periphery end being pressed into the notches 24 to interconnect both blocks;
- straight links 34 joining opposite corners of the rectangular-shape, thus maintaining firmly the spaced apart position of the blocks and avoiding shifting of the blocks.
- A center transversal member 38 to further reinforce the ties to resist shear forces when blocks are subjected to oscillating. On the transversal member, pegs 40 extend out of the periphery, to be pressed into notches 24 of the blocks.

The pegs are provided to mesh with critical positions in the blocks for stable junctions.

The pegs may be round pegs 42 or flat pegs 41.

Means of lifting 36 are used in the crossed ties to lift the whole combination of interconnected blocks. The means of lifting are snake-shape transversal members tied by their ends. Channel 52 are made in rectangular-shape ends 31 to pass the means of lifting through, when one lifts them up, thus avoiding a gap between two interconnected blocks pressed aside against each other when erecting wall construction.

The crossed ties may comprise a retainer hook 50 to hook on robber rings for keeping parallel back and front blocks together when erecting sound barrier walls.

The crossed ties are preferably made of plastic.

It is to be clearly understood that the instant description with reference to the annexed drawing is made in an indicative manner and that the preferred embodiments described herein are meant in no way to limit further embodiments realizable within the scope of the invention.

LEGEND

20 Assembly
22,22' Blocks
24,24' Notches
25-25' Interior faces
26 Channel
27,27' Exterior faces
28,29 Crossed ties
30 Rectangular shape
31 End members
32 Side members
34 Straight links
36 Means of lifting
38 Center transversal member
40 Pegs
41 Plat pegs
42 Round pegs
48 in between block
50 Retainer hook
52 Channels

We claim:

1. A construction-block unit comprising:
a first block having an interior surface;
a second block having an interior surface, and being arranged with respect to the first block so that the interior surface of the second block faces the interior surface of the first block; and
a plurality of crossed ties which connects the first block to the second block, each crossed tie comprising:
a left extension which extends between the first block and the second block;
a right extension which extends between the first block and the second block;
a front extension which connects a front end of the left extension to a front end of the right extension;
a rear extension which connects a rear end of the left extension to a rear end of the right extension;
a first straight link which connects a front left corner of the tie, located closer to a location at which the front extension connects to the left extension than to both a center of the front extension and a center of the left extension, to a rear right corner of the tie, located closer to a location at which the rear extension connects to the right extension than to both a center of the rear extension and a center of the right extension; and
a second straight link which connects a rear left corner of the tie, located closer to a location at which the rear extension connects to the left extension than to both a center of the rear extension and a center of the left extension, to a front right corner of the tie, located closer to a location at which the front extension connects to the right extension than to both a center of the front extension and a center of the right extension;
wherein each of the first and second blocks further comprise:
a top surface;
a bottom surface;
a left end surface; and
a right end surface;
wherein at least one of the crossed ties connects the top surface of the first block to the top surface of the second block;
wherein at least one of the crossed ties connects the bottom surface of the first block to the bottom surface of the second block;
wherein at least one of the crossed ties connects the left end surface of the first block to the left end surface of the second block; and
wherein at least one of the crossed ties connects the right end surface of the first block to the right end surface of the second block.

2. The construction-block unit of claim 1;
wherein each crossed tie comprises a central transversal member which connects the front extension to the rear extension, and which is arranged between the left extension and the right extension.

3. The construction-block unit of claim 1;
wherein each crossed tie comprises means of lifting to lift the construction-block unit.

4. The construction-block unit of claim 3;
wherein said means of lifting are curved transversal members.

5. The construction-block unit of claim 1;
wherein each crossed tie comprise a retainer hook.

6. The construction-block unit of claim 1;
wherein said crossed ties are made of plastic.

7. The construction-block unit of claim 3;
wherein said means of lifting are made of plastic.

8. The construction-block unit of claim 3, further comprising:
channels configured to accept at least a portion of said means of lifting so as to allow the means of lifting to extend from an inside of the construction-block unit to an outside of the construction-block unit.

9. The construction-block unit of claim 1;
wherein the interior surface of the first block comprises first notches on a periphery of the interior surface;
wherein the interior surface of the second block comprises second notches on a periphery of the interior surface;
wherein each crossed tie further comprises pegs extending into the first and second notches to interconnect the first and second blocks.

10. The construction-block unit of claim 1;
wherein each crossed tie comprises:
a plurality of pegs which extend out of a periphery of the crossed tie; and
wherein each of the plurality of pegs is connected to the first block of the second block.

11. The construction-block unit of claim 10;
wherein said pegs are round pegs.

12. The construction-block unit of claim 10;
wherein said pegs are flat pegs.

13. A construction-block unit comprising:
a first block having an interior surface;
a second block having an interior surface, and being arranged with respect to the first block so that the interior surface of the second block faces the interior surface of the first block; and a plurality of crossed ties which connects the first block to the second block, the each crossed tie being made of plastic and comprising:

a left extension which extends between the first block and the second block;

a right extension which extends between the first block and the second block;

a front extension which connects a front end of the left extension to a front end of the right extension;

a rear extension which connects a rear end of the left extension to a rear end of the right extension;

a first cross extension which connects a front left corner of the tie, located closer to a location at which the front extension connects to the left extension than to both a center of the front extension and a center of the left extension, to a rear right corner of the tie, located closer to a location at which the rear extension connects to the right extension than to both a center of the rear extension and a center of the right extension; and a second cross extension which connects a rear left corner of the tie, located closer to a location at which the rear extension connects to the left extension than to both a center of the rear extension and a center of the left extension, to a front right corner of the tie, located closer to a location at which the front extension connects to the right extension than to both a center of the front extension and a center of the right extension;

wherein each of the first and second blocks further comprise:

a top surface;

a bottom surface;

a left end surface; and a right end surface;

wherein at least one of the crossed ties connects the top surface of the first block to the top surface of the second block;

wherein at least one of the crossed ties connects the bottom surface of the first block to the bottom surface of the second block;

wherein at least one of the crossed ties connects the left end surface of the first block to the left end surface of the second block; and wherein at least one of the crossed ties connects the right end surface of the first block to the right end surface of the second block.

14. The construction-block unit of claim 1;

wherein each of the first and second blocks comprises at least one material selected from the group consisting of concrete, wood, rock, and stone.

15. The construction-block unit of claim 13;

wherein each of the first and second blocks comprises at least one material selected from the group consisting of concrete, wood, rock, and stone.

* * * * *